US010829878B2

(12) United States Patent
Hamada et al.

(10) Patent No.: US 10,829,878 B2
(45) Date of Patent: Nov. 10, 2020

(54) WARP KNIT FABRICS WITH VARIABLE PATH WEFT STRANDS

(71) Applicant: Apple Inc., Cupertino, CA (US)

(72) Inventors: Yohji Hamada, Wakayama (JP); Daniel A. Podhajny, San Jose, CA (US); Daniel D. Sunshine, Sunnyvale, CA (US); Kathryn P. Crews, Menlo Park, CA (US); Joseph B. Walker, Campbell, CA (US)

(73) Assignee: Apple Inc., Cupertino, CA (US)

( * ) Notice: Subject to any disclaimer, the term of this patent is extended or adjusted under 35 U.S.C. 154(b) by 87 days.

(21) Appl. No.: 15/913,653

(22) Filed: Mar. 6, 2018

(65) Prior Publication Data

US 2018/0195218 A1 Jul. 12, 2018

Related U.S. Application Data

(63) Continuation of application No. 15/738,096, filed as application No. PCT/US2016/038678 on Jun. 22, 2016, now abandoned.

(Continued)

(51) Int. Cl.
*D04B 21/08* (2006.01)
*D04B 23/22* (2006.01)

(Continued)

(52) U.S. Cl.
CPC ..... *D04B 21/08* (2013.01); *D04B 21/06* (2013.01); *D04B 21/14* (2013.01); *D04B 23/22* (2013.01);

(Continued)

(58) Field of Classification Search
CPC ..... D04B 21/08; D04B 23/12; D04B 25/12; D04B 23/22; D04B 21/14
See application file for complete search history.

(56) References Cited

U.S. PATENT DOCUMENTS 3,733,859 A * 5/1973 Wittmann ..... D04B 21/12 66/193
4,918,793 A * 4/1990 Spindler ..... A44B 19/406 24/392

(Continued)

FOREIGN PATENT DOCUMENTS

DE 299 01 225 5/1999
DE 102013018883 5/2015

(Continued)

OTHER PUBLICATIONS

Raz,"The Karl Mayer Guide to Technical Textiles" edited by Karl Mayer Textilmaschinenfabrik GmbH, Obertshausen, Germany, 2000, 36 pages.

*Primary Examiner* — Danny Worrell
(74) *Attorney, Agent, or Firm* — Treyz Law Group, P.C.; Kendall W. Abbasi

(57) ABSTRACT

An item may include fabric or other materials formed from intertwined strands of material. The strands of material may include non-conductive strands and conductive strands. The strands may be intertwined by a warp knitting machine to produce a warp knit fabric. The warp knit fabric may include intertwined warp strands and weft insertion strands that are inserted amongst the warp strands. The weft insertion strands may extend across less than all of the warp strands. The weft insertion strands may include parallel segments that each extend across a different portion of the warp strands. The segments of weft insertion strands may have different widths relative to one another and relative to the width of the fabric. The weft insertion strands may be inserted into the warp knitting machine across the warp strands using a weft insertion device that is positioned by a computer-controlled positioner.

13 Claims, 16 Drawing Sheets

Related U.S. Application Data

(60) Provisional application No. 62/186,285, filed on Jun. 29, 2015.

(51) Int. Cl.
*D04B 21/14* (2006.01)
*D04B 21/06* (2006.01)

(52) U.S. Cl.
CPC ..... *D10B 2401/16* (2013.01); *D10B 2401/18* (2013.01); *D10B 2403/021* (2013.01)

(56) References Cited

U.S. PATENT DOCUMENTS 5,265,445 A * 11/1993 Shytles ..... D04B 21/10 602/76
5,290,619 A * 3/1994 Siegel ..... D04B 21/16 428/102
5,502,986 A * 4/1996 Matsuda ..... A44B 19/343 24/392
5,585,169 A * 12/1996 Schnegg ..... D04B 21/165 428/304.4
5,797,283 A * 8/1998 Kaczmarczyk ..... D04B 21/12 66/193
5,809,805 A * 9/1998 Palmer ..... D04H 3/002 442/314
6,276,177 B1 * 8/2001 West ..... D04B 21/12 442/306
6,745,599 B2 * 6/2004 Bailey ..... D04B 21/16 66/192
7,293,434 B2 * 11/2007 Ikeguchi ..... A44B 19/40 66/193
2003/0106346 A1 6/2003 Matsumoto
2013/0102217 A1 4/2013 Jeon
2014/0273699 A1 9/2014 Zhang et al.

FOREIGN PATENT DOCUMENTS

FR 2695003 3/1994
JP S61-027085 2/1986
JP 2009091674 4/2009
JP 2012-136813 7/2012
JP 2013517389 A 5/2013
JP 2015-093137 5/2015

* cited by examiner

WARP KNIT FABRICS WITH VARIABLE PATH WEFT STRANDS

This application claims priority to U.S. patent application Ser. No. 15/738,096, filed Dec. 19, 2017, which is a 35 U.S.C. 371 national stage application of international application No. PCT/US2016/038678, filed Jun. 22, 2016, which claims the benefit of provisional patent application No. 62/186,285, filed Jun. 29, 2015, all of which are hereby incorporated by reference herein in their entireties.

BACKGROUND

This relates generally to items formed from strands of material and, more particularly, to items formed from intertwined conductive and non-conductive strands of material.

It may be desirable to form items such a bags, clothing, and other items from intertwined strands of material. For example, woven or knitted fabric or braided strands may be used in forming portions of an item.

In some situations, it may be desirable to form items using warp knit fabric. Warp knit fabrics allow for a variety of fabric constructions and can be knitted into three-dimensional structures with multiple layers.

Warp knit fabrics sometimes include inserted weft and/or warp threads. The inserted weft and warp threads lie flat in the knitted fabric and can provide strength and rigidity to the fabric.

In conventional warp knitting machines, weft threads are inserted using a weft thread carrier that holds each weft thread across the entire width of the knitting machine. Weft threads that are inserted in the fabric with this type of equipment have a fixed path, typically spanning the entire width of the fabric.

Having weft threads restricted to one width and one pattern in a warp knit fabric can place undesirable limitations on the layout and design of the warp knit fabric. These limitations are especially cumbersome when forming fabrics with conductive signal paths and conductive regions. For example, fixed-pattern weft threads in a warp knit fabric cannot be used to form conductive regions of different shapes, sizes, and patterns in the fabric.

It would therefore be desirable to be able to form improved fabric constructions for warp knit fabrics.

SUMMARY

An item may include fabric or other materials formed from intertwined strands of material. The strands of material may include non-conductive strands and conductive strands. The strands may be intertwined by a warp knitting machine to produce a warp knit fabric. The warp knit fabric may include intertwined warp strands and weft insertion strands that are inserted amongst the warp strands.

The weft insertion strands may extend across less than all of the warp strands in the warp knit fabric. The weft insertion strands may include parallel segments in the fabric that each extend across a different portion of the warp strands. The segments of weft insertion strands may have different widths relative to one another and relative to the width of the fabric. For example, some weft insertion strands may extend across the entire width of the fabric whereas other weft insertion strands may extend across only a portion of the width of the fabric.

To form a warp knit fabric having weft insertion strands of variable width, weft insertion strands may be inserted into a warp knitting machine using a weft insertion device that is positioned by a computer-controlled positioner. The computer-controlled positioner may move the weft insertion device across a desired width of the fabric corresponding to the desired width of the weft strand in the fabric. The weft insertion device may feed a weft strand into the warp knitting machine as the weft insertion device moves the desired distance across the warp knitting machine. If desired, multiple weft insertion devices may be used in parallel to insert multiple weft strands into the fabric during knitting. The weft insertion devices may be independently controlled and, if desired, may produce different weft strand patterns in the fabric.

In other arrangements, the weft insertion strands may be preloaded onto a conveyor surface in a pattern corresponding to the pattern to be created in the warp knit fabric. For example, the weft insertion strands may be wrapped around a series of posts on the conveyor surface to create parallel segments having different widths. They conveyor may feed each segment into the warp knitting machine to thereby embed weft insertion strands of variable widths in the warp knit fabric.

The warp knitting machine may be a tricot knitting machine, a single needle bar Raschel knitting machine, a double needle bar knitting machine, or other suitable knitting machine. In a double needle bar Raschel knitting machine, a multi-layer fabric may be produced. For example, a warp knit textile having first and second layers and a spacer layer joining the first and second layers may be produced. If desired, any one or more of the layers in a multi-layer warp knit textile may include weft insertion fibers having variable paths.

DETAILED DESCRIPTION

Figure 1:
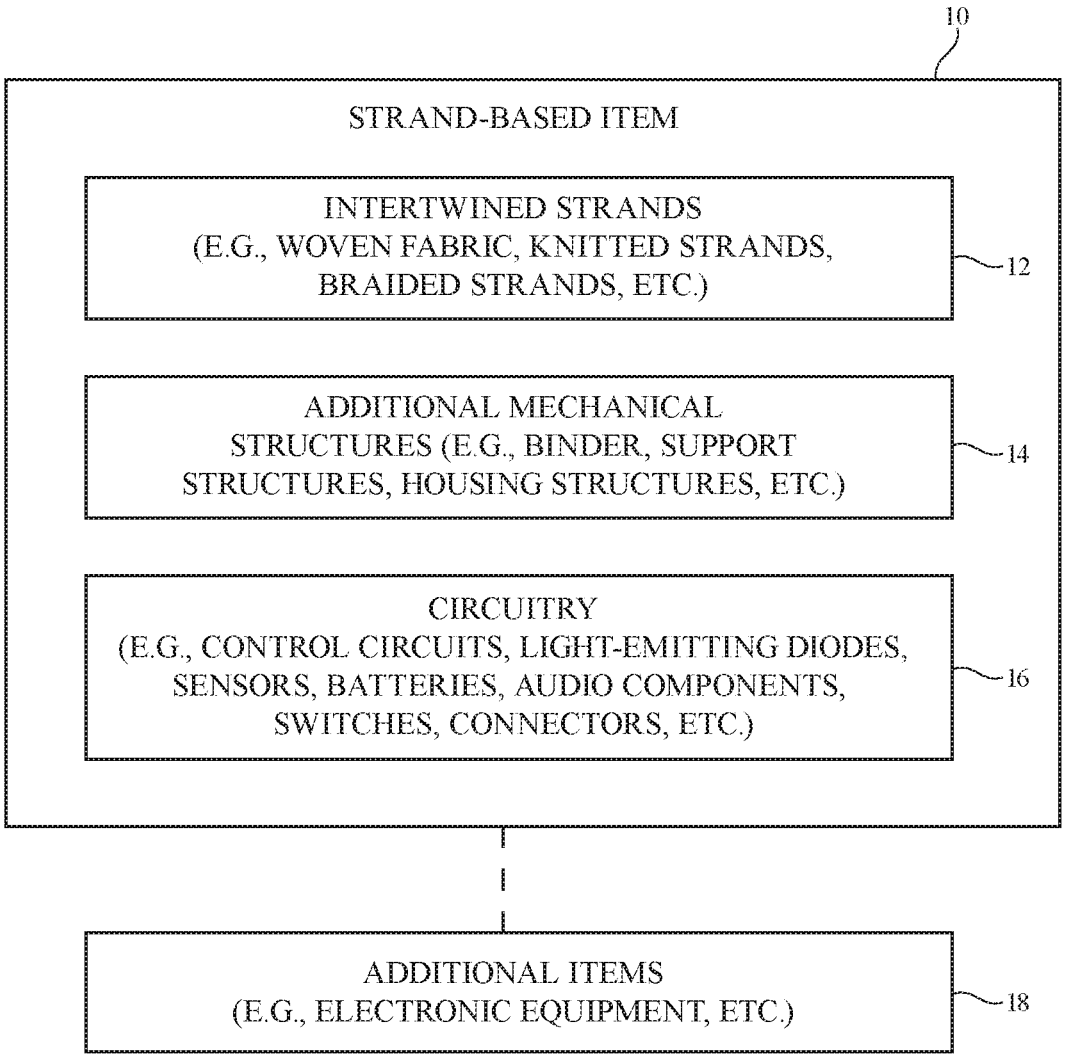
FIG. 1 is a schematic diagram of an illustrative item that may include strands of material in accordance with an embodiment.

Strands of material may be incorporated into strand-based items such as strand-based item 10 of FIG. 1. Item 10 may be an electronic device or an accessory for an electronic device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which fabric-based item 10 is mounted in a kiosk, in an automobile, airplane, or other vehicle, other electronic equipment, or equipment that implements the functionality of two or more of these devices. If desired, item 10 may be a removable external case for electronic equipment, may be a strap, may be a wrist band or head band, may be a removable cover for a device, may be a case or bag that has straps or that has other structures to receive and carry electronic equipment and other items, may be a necklace or arm band, may be a wallet, sleeve, pocket, or other structure into which electronic equipment or other items may be inserted, may be part of a chair, sofa, or other seating (e.g., cushions or other seating structures), may be part of an item of clothing or other wearable item (e.g., a hat, belt, wrist band, headband, etc.), or may be any other suitable strand-based item.

Strands in strand-based item 10 may form all or part of a housing wall for an electronic device, may form internal structures in an electronic device, or may form other strand-based structures. Strand-based item 10 may be soft (e.g., item 10 may have a fabric surface that yields to a light touch), may have a rigid feel (e.g., the surface of item 10 may be formed from a stiff fabric), may be coarse, may be smooth, may have ribs or other patterned textures, and/or may be formed as part of a device that has portions formed from non-fabric structures of plastic, metal, glass, crystalline materials, ceramics, or other materials.

Item 10 may include intertwined strands 12. The strands may be intertwined using strand intertwining equipment such as weaving equipment, knitting equipment, braiding equipment, or equipment that intertwines strands by entangling the strands with each other in other ways (e.g., to form felt). Intertwined strands 12 may, for example, form woven or knitted fabric or other fabric (i.e., item 10 may be a fabric-based item), a braided cord, etc.

Strands 12 may be single-filament strands or may be threads, yarns, or other strands that have been formed by intertwining multiple filaments of material together. Strands 12 may be formed from polymer, metal, glass, graphite, ceramic, natural fibers such as cotton, bamboo, wool, or other organic and/or inorganic materials and combinations of these materials. Strands 12 may be insulating or conductive.

Conductive coatings such as metal coatings may be formed on non-conductive strands (e.g., plastic cores) to make them conductive and strands such as these may be coated with insulation or left bare. Reflective coatings such as metal coatings may be applied to strands 12 to make them reflective. Strands 12 may also be formed from single-filament metal wire, multifilament wire, or combinations of different materials.

Strands 12 may be conductive along their entire length or may have conductive segments (e.g., metal portions that are exposed by locally removing insulation or that are formed by adding a conductive layer to a portion of a non-conductive strand.). Threads and other multifilament yarns that have been formed from intertwined filaments may contain mixtures of conductive fibers and insulating fibers (e.g., metal strands or metal coated strands with or without exterior insulating layers may be used in combination with solid plastic fibers or natural fibers that are insulating).

Item 10 may include additional mechanical structures 14 such as polymer binder to hold strands 12 together, support structures such as frame members, housing structures (e.g., an electronic device housing), and other mechanical structures.

Circuitry 16 may be included in item 10. Circuitry 16 may include components that are coupled to strands 12, components that are housed within an enclosure formed by strands 12, components that are attached to strands 12 using welds, solder joints, adhesive bonds (e.g., conductive adhesive bonds), crimped connections, or other electrical and/or mechanical bonds. Circuitry 16 may include metal structures for carrying current, integrated circuits, discrete electrical components such as resistors, capacitors, and inductors, switches, connectors, light-emitting components such as light-emitting diodes, audio components such as microphones and speakers, vibrators, solenoids, piezoelectric devices, and other electromechanical devices, connectors, microelectromechanical systems (MEMs) devices, pressure sensors, light detectors, proximity sensors, force sensors, moisture sensors, temperature sensors, accelerometers, gyroscopes, compasses, magnetic sensors, touch sensors, and other sensors, components that form displays, touch sensors arrays (e.g., arrays of capacitive touch sensor electrodes to form a touch sensor that detects touch events in two dimensions), and other input-output devices. Circuitry 16 may also include control circuitry such as non-volatile and volatile memory, microprocessors, application-specific integrated circuits, system-on-chip devices, baseband processors, wired and wireless communications circuitry, and other integrated circuits.

Item 10 may interact with electronic equipment or other additional items 18. Items 18 may be attached to item 10 or item 10 and item 18 may be separate items that are configured to operate with each other (e.g., when one item is a case and the other is a device that fits within the case, etc.). Circuitry 16 may include antennas and other structures for supporting wireless communications with item 18. Item 18 may also interact with strand-based item 10 using a wired communications link or other connection that allows information to be exchanged.

In some situations, item 18 may be an electronic device such as a cellular telephone, computer, or other portable electronic device and strand-based item 10 may form a case or other structure that receives the electronic device in a pocket, an interior cavity, or other portion of item 10. In other situations, item 18 may be a wrist-watch device or other electronic device and item 10 may be a strap or other strand-based item that is attached to item 18. In still other situations, item 10 may be an electronic device, strands 12 may be used in forming the electronic device, and additional items 18 may include accessories or other devices that interact with item 10.

If desired, magnets and other structures in items 10 and/or 18 may allow items 10 and 18 to interact wirelessly. One item may, for example, include a magnet that produces a magnetic field and the other item may include a magnetic switch or magnetic sensor that responds in the presence of the magnetic field. Items 10 and 18 may also interact with themselves or each other using pressure-sensitive switches, pressure sensors, force sensors, proximity sensors, light-based sensors, interlocking electrical connectors, etc.

The strands that make up item 10 may be intertwined using any suitable strand intertwining equipment. For example, strands 12 may be woven together to form a fabric. The fabric may have a plain weave, a satin weave, a twill weave, or variations of these weaves, may be a three-dimensional woven fabric, or may be other suitable woven fabric. If desired, the strands that make up item 10 may be intertwined using knitting equipment, braiding equipment, or other strand intertwining equipment. Item 10 may also incorporate more than one type of fabric or intertwined strand-based material (e.g., item 10 may include both woven and knitted portions).

Figure 2:
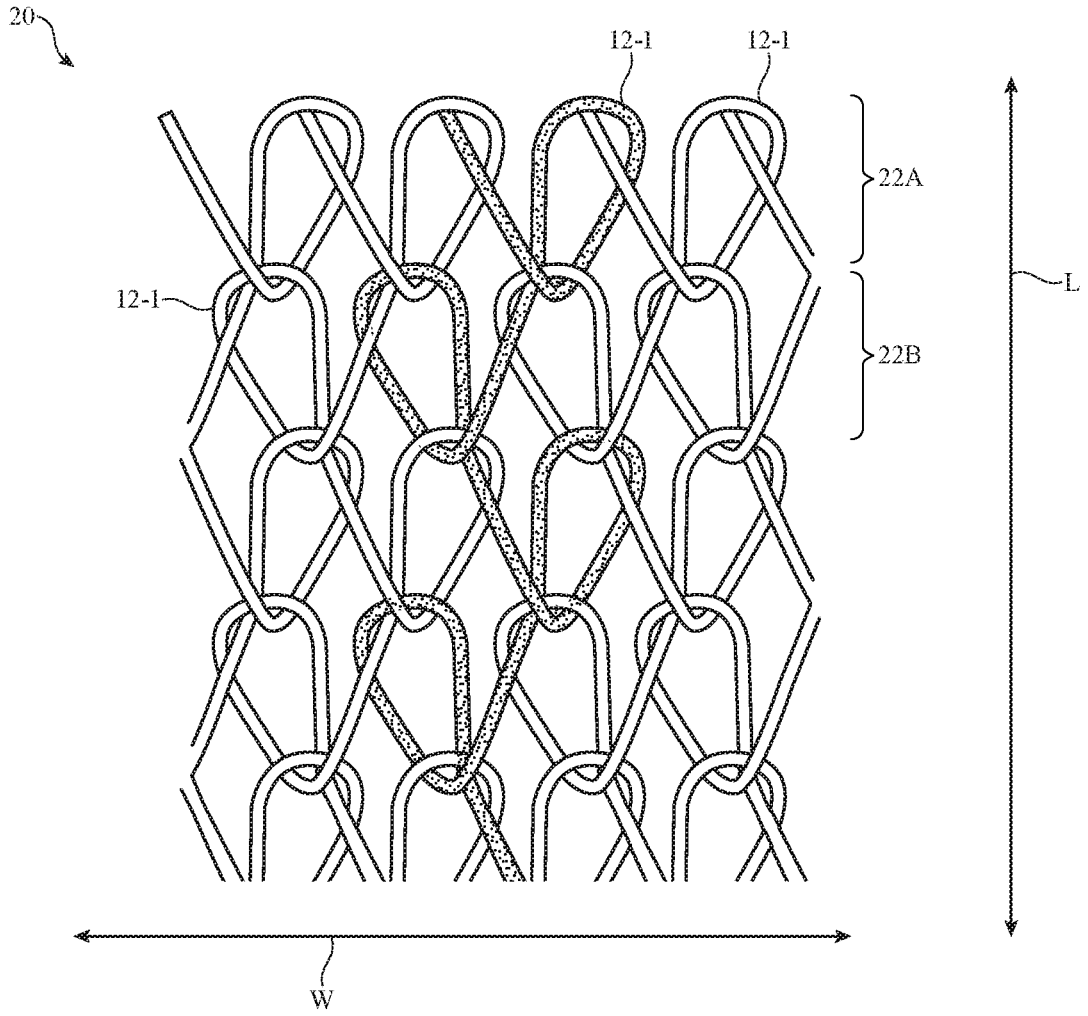
FIG. 2 is a top view of a portion of a warp knit fabric that may include conductive strands in accordance with an embodiment.

The strands that make up item 10 may be intertwined to form a fabric such as illustrative fabric 20 of FIG. 2. Fabric 20 may include strands 12. Strands 12 may be formed from conductive and/or insulating materials. As an example, fabric may be formed from insulating strands interspersed with conductive strands. In the illustrative configuration of FIG. 2, fabric 20 is a warp knit fabric having columns of warp strands 12-1 that zigzag along the length L of fabric 20. Each warp strand 12-1 has a number of loops, with each loop securing a loop of an adjacent strand from a previous row. For example, the loops of row 22B in fabric 20 secure the loops of row 22A in fabric 20.

Figure 3:
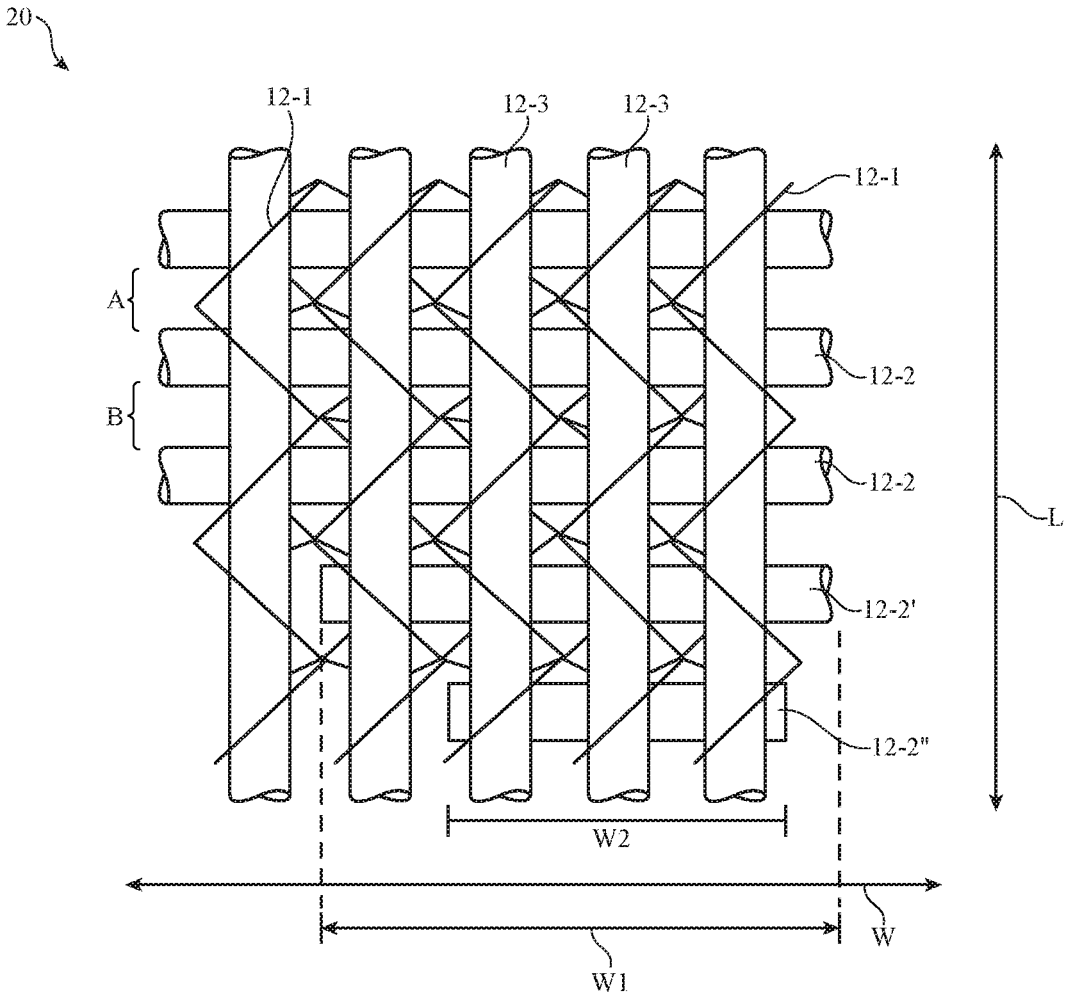
FIG. 3 is a top view of a portion of a warp knit fabric having weft insertion strands with different widths in accordance with an embodiment.

If desired, additional strands may be inserted into a warp knit fabric. For example, as shown in FIG. 3, fabric 20 may include weft strands 12-2 and warp strands 12-3 that are inserted into the intertwined warp strands 12-1. Weft strands 12-2 that are inserted across the width W of fabric 20 may sometimes be referred to as weft insertion strands. Warp strands 12-3 that are inserted along the length L of fabric 20 may sometimes be referred to as warp insertion strands.

In contrast to woven fabrics in which weft threads have a wave-like shape due to the over-under weaving pattern, weft insertion strands 12-2 are able to lie flat in fabric 20 because the strands are inserted into fabric 20 between rows of stitching. For example, as shown in FIG. 3, weft insertion strand 12-2 is inserted into fabric 20 between row A of stitches and row B of stiches.

Weft insertion strands 12-2 and warp insertion strands 12-3 may be formed from the same material as warp strands 12-1 or may be formed from a different material. For example, warp strands 12-1 may be insulating strands while weft insertion strands 12-2 and/or warp insertion strands 12-3 may be conductive strands. If desired, warp strands 12-1 may be conductive strands while weft insertion strands 12-2 and/or warp insertion strands 12-3 may be insulating strands.

The distance spanned by a weft insertion strand across a fabric may be referred to herein as the "width" of the weft insertion strand. Because a single weft strand may form multiple rows in a fabric, the width of a weft insertion strand may sometimes refer to the width of a given row formed by a segment of a weft insertion strand. For example, weft strand 12-2' and weft-strand 12-2" may be formed from two separate weft strands or may be formed from a single weft strand that extends back and forth across the fabric. In other words, a single weft strand may have multiple widths, with each width corresponding to a respective row formed by a segment of the weft strand.

To accommodate different fabric patterns and designs, fabric 20 may include weft insertion strands 12-2 that follow a variable pattern in fabric 20. For example, weft insertion strands 12-2 may span various distances across the width of fabric 20. Some weft insertion strands 12-2 span the width W of fabric 20 (e.g., extending across all of warp fibers 12-1), while other weft insertion strands such as strand 12-2' and 12-2" do not span the entire width W of fabric 20 (e.g., extending across less than all of warp fibers 12-1). In the illustrative example of FIG. 3, strand 12-2' has a width W1 that is less than width W of fabric 20 and strand 12-2" has a width W2 that is less than width W of fabric 20 and width W1 of strand 12-1. Varying the width of weft insertion strands 12-2 may allow patterns that would otherwise not be possible in a warp knit fabric.

Figure 4:
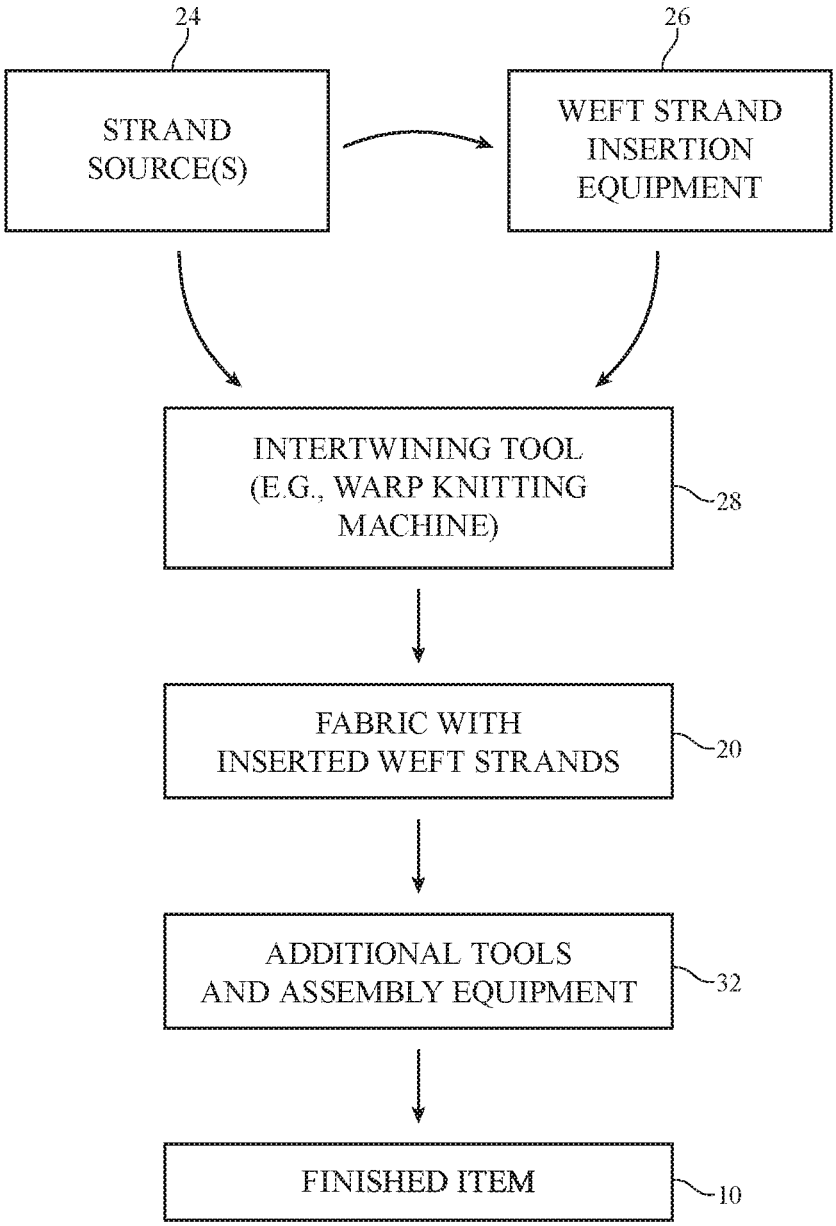
FIG. 4 is a diagram of illustrative equipment for forming warp knit fabrics having weft insertion strands with different patterns in accordance with an embodiment.

Illustrative equipment and operations of the type that may be involved in forming fabric-based items that include weft insertion strands of variable patterns are shown in FIG. 4.

As shown in FIG. 4, the equipment of FIG. 4 may be provided with strands from strand source 24. The strands provided by strand source 24 may be single-strand filaments or may be threads, yarns, fibers, or other strands that have been formed by intertwining single-strand filaments. Strands may be formed from polymer, metal, glass, graphite, ceramic, natural materials such as cotton or bamboo, or other organic and/or inorganic materials and combinations of these materials. Conductive coatings such as metal coatings may be formed on non-conductive strand cores. Strands may also be formed from single filament metal wire or stranded wire. Strands may be insulating or conductive. Strands may be conductive along their entire length or may have conductive segments (e.g., metal portions that are exposed by locally removing polymer insulation from an insulated conductive fiber). Threads and other multi-strand bundles that have been formed from intertwined filaments may contain mixtures of conductive strands and insulating strands (e.g., metal strands or metal coated strands with or without exterior insulating layers may be used in combination with solid plastic strands or natural strands that are insulating).

Strand source 24 may provide warp strands (e.g., warp strands 12-1 of FIG. 3) to intertwining equipment 28 and weft strands (e.g., weft insertion strands 12-2 of FIG. 3) to weft strand insertion equipment 26. Weft strand insertion equipment 26 may feed weft strands 12-2 into intertwining equipment 28.

Warp strands 12-1 (FIG. 3) from strand source 24 and weft strands 12-2 from weft strand insertion equipment 26 may be intertwined using intertwining equipment 28 to produce fabric 20. Equipment 28 may include knitting equipment such as tricot knitting equipment, Raschel knitting equipment (e.g., single needle bar or double needle bar Raschel knitting equipment), Milanese knitting equipment, or other suitable equipment for intertwining strands from strand source 24. Equipment 28 may be automated. For example, equipment 28 may include computer-controlled actuators that manipulate and intertwine fibers from source 24. Intertwining equipment 28 may be configured to produce three-dimensional fabric structures (e.g., fabrics with potentially complex multi-layer structures). For example, intertwining equipment 28 may include knitting equipment that produces three-dimensional structures, a three-dimensional weaving machine, tools for producing three-dimensional braided fabrics, etc.

Weft strand insertion equipment 26 may include one or more feeders that feed weft strands 12-2 into warp knitting machine 28 during knitting. If desired, weft strand insertion equipment 26 may be automated. For example, equipment 26 may include computer-controlled actuators that control when weft strands 12-2 are inserted into knitting machine 28 and that controls the width spanned by each weft strand 12-2 in fabric 20. The widths spanned by weft strands 12-2 may be predetermined prior to knitting or may be determined and adjusted during the knitting process. Weft strand insertion equipment 26 may produce rows of weft strands 12-2 with variable widths in fabric 20.

As shown in FIG. 4, fabric 20 that includes inserted weft strands 12-2 may be processed using additional tools and assembly equipment 32. Equipment 32 may be used in processing strands 12. Equipment 32 may be used in forming electrical connections between strands 12 and attaching electronic components such as electronic components in circuitry 16 of FIG. 1 to strands such as conductive strands 12. For example, equipment 32 may be used to attach electrical components to strands 12 using solder joints, crimped metal connections, welds, conductive adhesive, or other conductive attachment structures. The electrical components that are attached to strands in this way may include light-emitting components, integrated circuits, light-emitting diodes, light-emitting diodes that are packaged with transistor-based circuitry such as communications circuitry and/or light-emitting diode driver circuitry that allows each component to operate as a pixel in a display, discrete components such as resistors, capacitors, and inductors, audio components such as microphones and/or speakers, sensors such as touch sensors (with or without co-located touch sensor processing circuitry), accelerometers, temperature sensors, force sensors, microelectromechanical systems (MEMS) devices, transducers, solenoids, electromagnets, pressure sensors, light-sensors, proximity sensors, buttons, switches, two-terminal devices, three-terminal devices, devices with four or more contacts, etc. Electrical connections for attaching electrical components to strands 12 using equipment 32 may be formed using solder, conductive adhesive, welds, molded package parts, mechanical fasteners, wrapped strand connections, press-fit connections, crimped connections (e.g., bend metal prong connections), and other mechanical connections, portions of liquid coatings (e.g., metallic paint, conductive adhesive, etc.) that are selectively applied to strands 12 using equipment 32, or using any other suitable arrangement for forming an electrical short between conductive structures.

Equipment 32 may be used to attach fabric 20 to housing structures formed from plastic, metal, glass, or other materials. Fabric 20 may be sewn, cut, and otherwise incorporated into fabric-based items to form a finished fabric-based item (e.g., electronic device 10).

Figure 5:
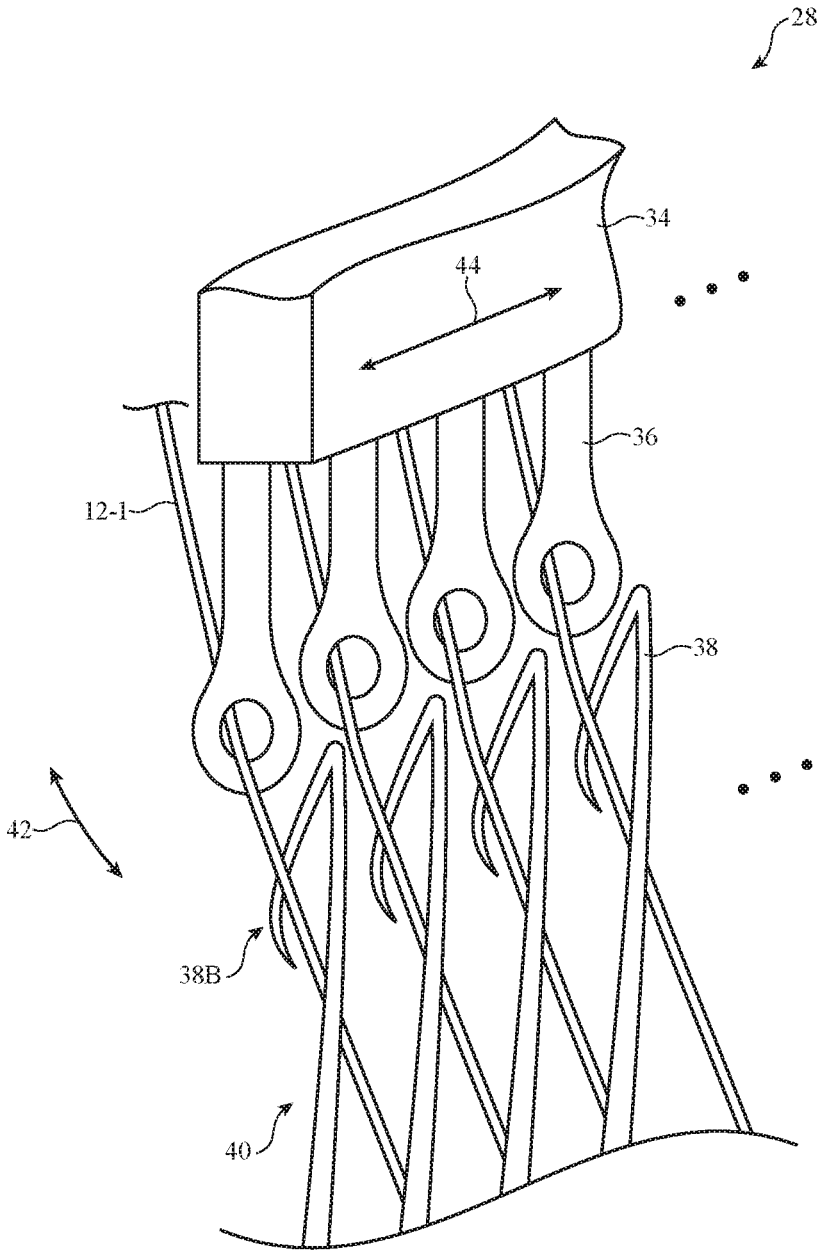
FIG. 5 is a perspective view of illustrative warp knitting equipment that may be used to form warp knit fabrics in accordance with an embodiment.

FIG. 5 is a perspective view of illustrative knitting equipment that may be used to knit fabric 20. As shown in FIG. 5, knitting equipment 20 may include guide bar 34 having a number of guides 36. Each warp thread 12-1 may be threaded through a respective one of guides 36. Needle bar 40 may include a number of needles 38. All of the needles 38 in needle bar 40 may move in unison. Needles 38 may be bearded needles having beards 38B or may be any other suitable type of knitting needle (e.g., latch needle, compound needle, carbine needle, etc.).

Figure 6:
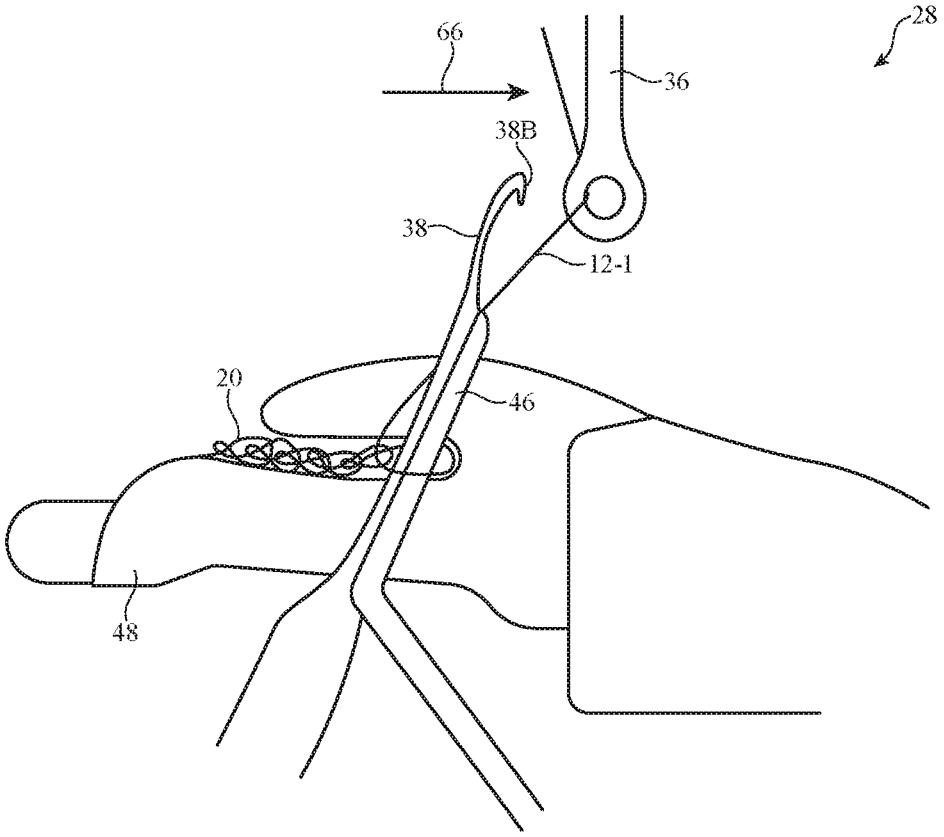
FIG. 6 is a side view of illustrative warp knitting equipment in a first position during loop formation in accordance with an embodiment.
Figure 7:
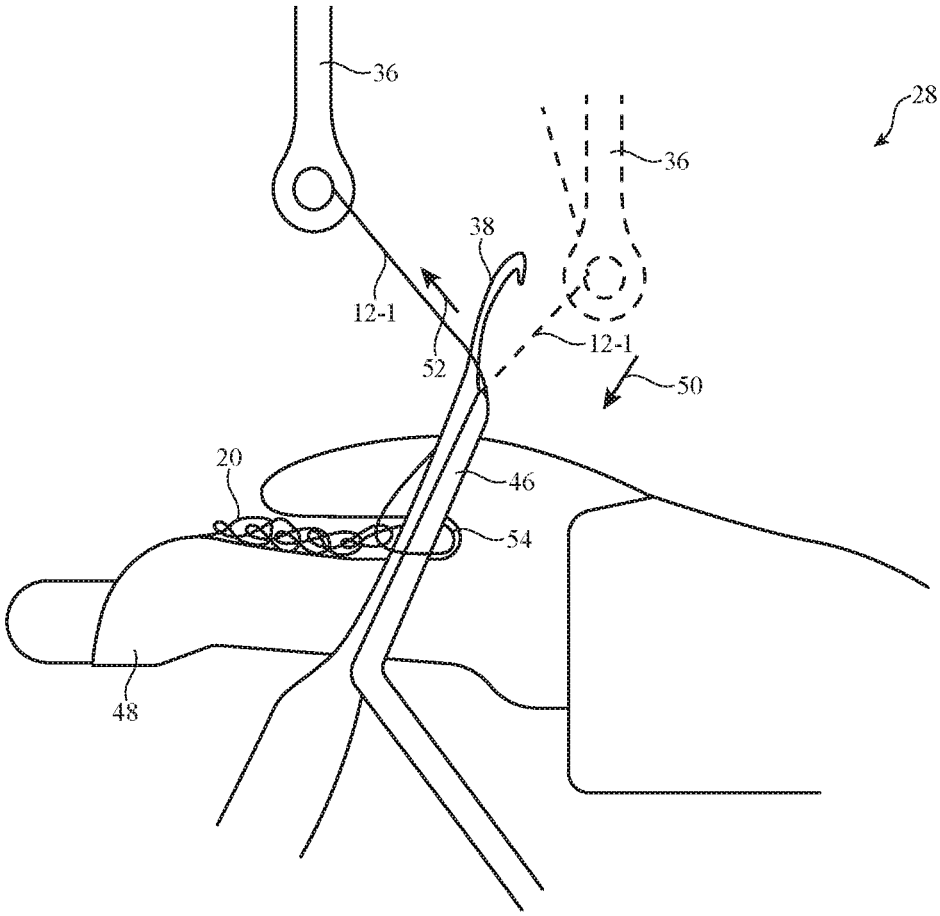
FIG. 7 is a side view of illustrative warp knitting equipment in a second position during loop formation in accordance with an embodiment.
Figure 8:
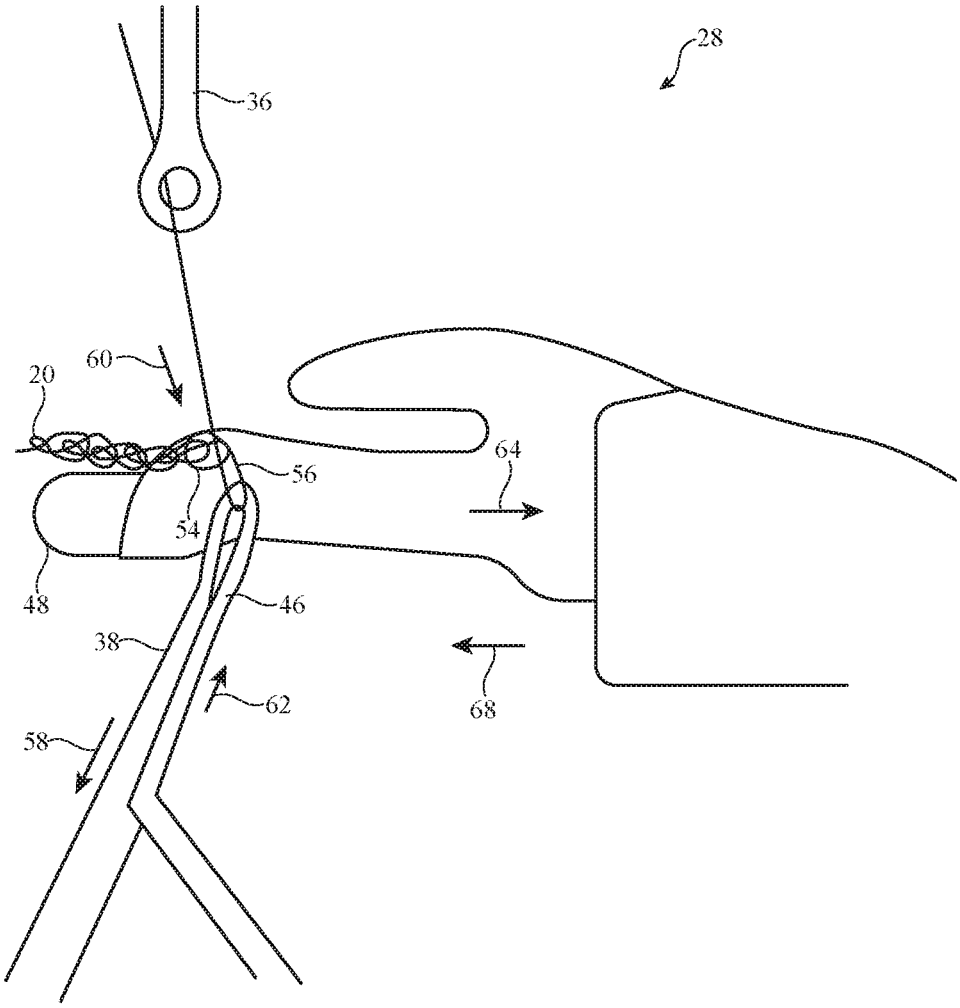
FIG. 8 is a side view of illustrative warp knitting equipment in a third position during loop formation in accordance with an embodiment.

Loops are made between adjacent warp strands 12-1 by moving various components of knitting machine 28. Guide bar 34 is configured to move back and forth between needles 38 along direction 42. This movement is sometimes referred to as a swing. Guide bar 34 is also configured to move laterally in direction 44, either in front of or behind needles 38. This movement is sometimes referred to as a shog. FIGS. 6, 7, and 8 show how loops are formed in a warp knit fabric using knitting equipment of the type shown in FIG. 5.

As shown in FIG. 6, loop formation begins with guide 36 swinging in direction 66 from the front of machine 28 (e.g., opposite the open side of needles 38) to the back of machine 28 (e.g., on the open side of needles 38) to bring warp thread 12-1 between adjacent needles 38 to the back of machine 28. At this stage, closing structure 46 is down such that beard 38B of needle 38 is open.

In FIG. 7, guide 36 is shogged laterally behind needle 38 in direction 50 to overlap warp strand 12-1 behind needle 38. Following this lateral shog, guide 36 swings from back to front in direction 52, bringing warp thread 12-1 back between needles 38 (e.g., on the opposite side of needle 38 as the front-to-back swing of FIG. 6).

In FIG. 8, closing structure 46 has moved upwards in direction 62 to trap newly made loop 56 (e.g., the loop around needle 38 formed from the overlap step of FIG. 7) in needle 38. Closed needle 38 then moves downward in direction 58 to pull new loop 56 in direction 60 through a previously made loop such as old loop 54, which is wrapped around a lower portion of needle 38. After new loop 56 has been pulled through old loop 54, sinkers such as sinker 48 may be moved backwards in direction 64 to release old loop 54 (a process sometimes referred to as knock-over). After disengaging the old loops from needle 38, sinker 46 may move forward in direction 68 to secure fabric 20 prior to needles 38 rising for the next cycle of loop formation.

The knitting equipment of FIGS. 5, 6, 7, and 8 is merely illustrative. Similar movements may apply with various types of knitting machines (e.g., tricot machines, Raschel machines, machines with compound needles, bearded needles, or other suitable type of needle, etc.).

Figure 9:
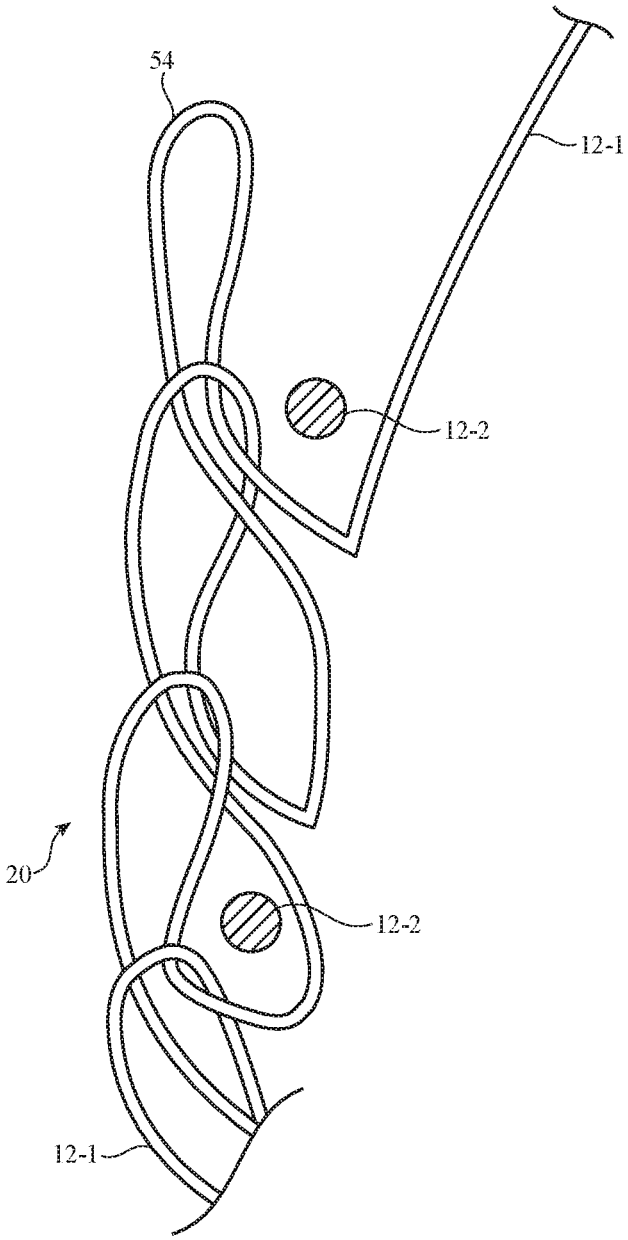
FIG. 9 is a cross-sectional side view of an illustrative warp knit fabric showing how weft insertion strands may be inserted during knitting in accordance with an embodiment.

FIG. 9 is a cross-sectional side view of a warp knit fabric 20 having inserted weft strands. As shown in FIG. 9, weft insertion strands 12-2 may be inserted into fabric 20 between previously formed loops 54 of fabric 20 prior to pulling a new loop (e.g., a new loop such as loop 56 of FIG. 8) through previously formed loop 54. Once the new loops are pulled through the old loops, warp insertion strands 12-2 may be integrated into fabric 20.

Figure 10:
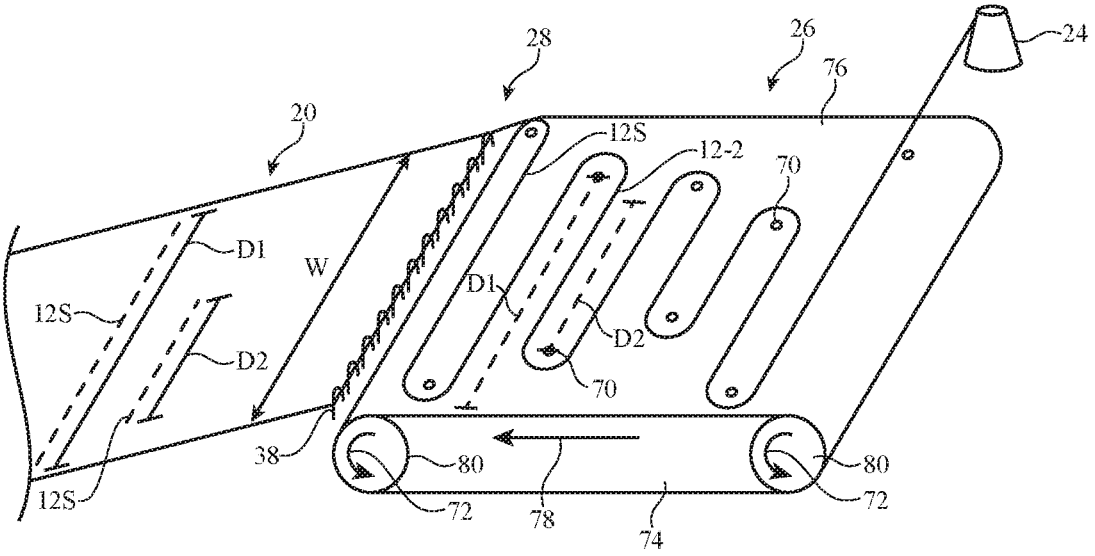
FIG. 10 is a perspective view of illustrative equipment including a weft insertion device on which weft insertion strands with variable widths are placed in a predetermined pattern in accordance with an embodiment.

FIG. 10 is a perspective view of illustrative equipment that may be used to insert weft strands 12-2 into fabric 20 during knitting. As shown in FIG. 10, weft strand insertion equipment 26 may include a conveyor belt structure such as conveyor 74 having a number of structures 70 (e.g., hooks, pins, posts, etc.) around which weft strands 12-2 are wrapped. Hooks 70 hold each weft strand segment 12S parallel to the width W of fabric 20. To insert weft strand segments 12S into fabric 20, rollers 80 rotate in direction 72 which in turn moves conveyor surface 76 in direction 78. Weft segments 12S are released from conveyor 74 and placed cross-wise into fabric 20 (see, e.g., FIG. 9).

A shown in FIG. 10, the width of weft strand segments 12S is determined by the spacing between posts 70. If desired, equipment 26 may have a uniform spacing between posts 70 to form weft segments of uniform width, or equipment 26 may have variable spacing between posts 70 to form weft segments with variable width, as shown in FIG. 10. For example, a distance D1 may separate one pair of opposing posts 70, while a distance D2 (e.g., a distance less than D1) may separate another pair of opposing posts.

If desired, the positions of posts 70 on conveyor surface 76 may be fixed or the positions may be adjustable. In either case, the weft insertion strand 12-2 may be pre-loaded onto conveyor surface 76 in a particular pattern. The pattern in which weft strand 12-2 is placed on conveyor surface 76 may correspond to the pattern to be created in fabric 20 with weft strand 12-2. For example, the distances D1 and D2 between neighboring pairs of posts 70 on conveyor surface 76 may create first and second weft insertion segments 12S in fabric 20 having widths D1 and D2.

The example of FIG. 10 in which weft insertion equipment 26 includes a conveyor system on which the pattern of weft insertion strands 12-2 is pre-loaded prior to inserting the weft strands 12-2 in fabric 20 is merely illustrative. If desired, weft insertion equipment 26 may include computer-controlled weft strand positioning equipment that precisely moves and positions weft strands in fabric 20. This type of arrangement is shown in FIG. 11.

Figure 11:
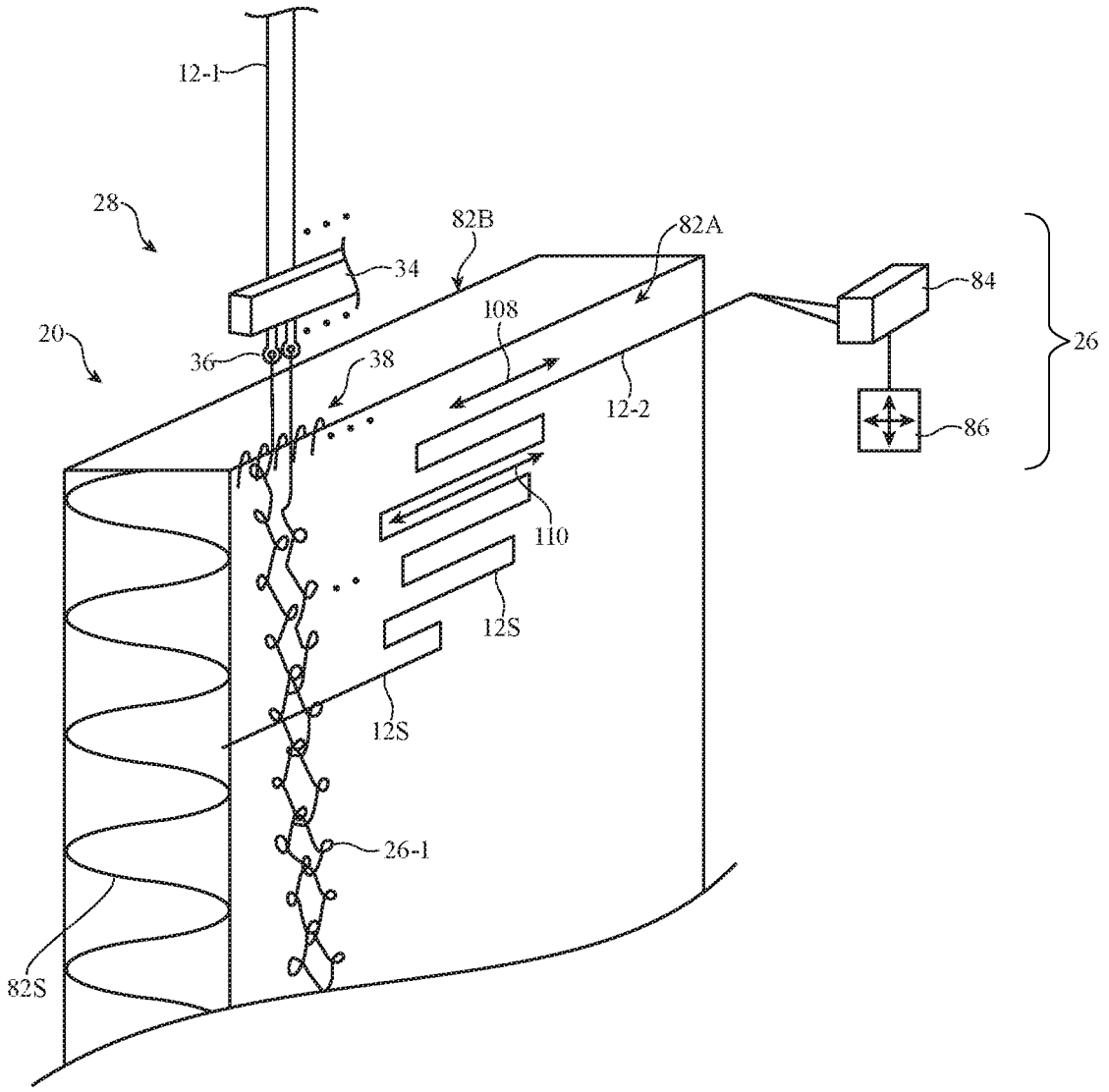
FIG. 11 is a perspective view of illustrative knitting equipment for knitting a multi-layer fabric including a weft insertion device that is positioned by a computer-controlled positioner in accordance with an embodiment.

In the illustrative example of FIG. 11, fabric 20 is a multi-layer fabric having a spacer layer 82S interposed between first and second outer layers 82A and 82B. Multi-layer fabrics of this type may, for example, be formed using Raschel double-needle bar machine in which threaded guide bars form outer layers 82A and 82B and an additional threaded guide bar is used to attach outer layer 82A and 82B with spacer layer 82S.

In some embodiments, the spacer construction of FIG. 11 may be used to form a touch-sensitive textile. Each outer layer 82A and 82B may include a set of conductive strands. The spacer layer may compress or deform in response to a touch on the textile, which, in some cases, causes the distance between conductive strands in layer 82A to come closer to the conductive strands in layer 82B. The change in distance between the conductive strands may cause a change in capacitance between the conductive strands, which may be monitored by a sensing circuit. If desired, a force associated with the touch may be determined based on the change in capacitance.

As shown in FIG. 11, weft strand positioning equipment 26 may include a feeder 84 (sometimes referred to as a carrier, a weft insertion device, or weft strand positioner) that feeds weft strands 12-2 into fabric 20 during weaving. The location at which weft strands 12-2 are inserted into fabric 20 may be similar to that of FIGS. 9 and 10 (e.g., between previously formed loops and newly wrapped strands to be looped with previously formed loops). In contrast to FIG. 10 where the pattern of weft strands 12-2 is formed on equipment 26 prior to insertion, equipment 26 of FIG. 11 produces the pattern of weft strands 12-2 as the weft strands are inserted into fabric 20. For example, rather than feeding knitting machine 28 a stretched weft strand that is stretched between two hooks, feeder 84 may move across knitting machine 28 along direction 108 while feeding weft strand 12-2 into fabric 20 as knitting machine 28 knits fabric 20.

Feeder 84 may be controlled by computer-controlled positioner 86. If desired, computer-controlled positioner 86 may synchronize the movement and placement of feeder 84 with the operation of knitting machine 28 such that the pattern of weft insertion strands 12-2 can be customized and adjusted during knitting without requiring any change in operation of knitting machine 28.

Computer-controlled positioner 86 manipulates feeder 84 to insert segments 12S of weft strands 12-2 in fabric 20. As shown in FIG. 11, weft segments 12S may have different widths and may span different portions of fabric 20. The width 110 of a given segment 12S in fabric 20 may be determined by the movement of weft insertion equipment 26. For example, to produce a segment of width 110 in fabric 20, computer-controlled positioner 86 may move insertion device 84 across width 110 while placing weft segment 12S into knitting machine 28. The weft segment is integrated into fabric 20 as knitting machine 28 forms loops with warp strands 12-1.

The example of FIG. 11 in which weft strand positioning equipment 26 includes one feeder 84 is merely illustrative. If desired, weft strand positioning equipment 26 may include multiple feeders 84. For example, one feeder 84 may feed weft strands 12-2 to layer 82A while another feeder 84 feeds weft strands 12-2 to layer 82B. If desired, weft strands 12-2 of layer 82A and weft strands 12-2 of layer 82B may be conductive and may overlap one another. The overlapping regions of conductive weft strands may, for example, form sensor electrodes as part of a touch sensor and/or force sensor in fabric 20.

Figure 12:
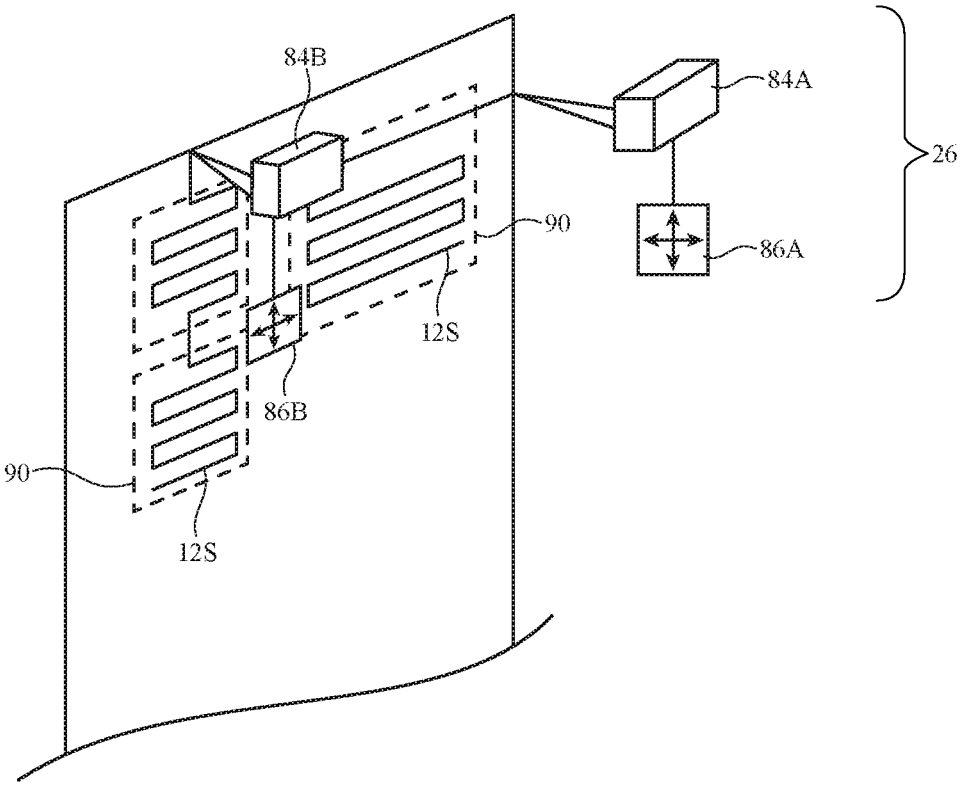
FIG. 12 is a perspective view of illustrative knitting equipment for knitting a fabric including multiple weft insertion devices that are positioned by computer-controlled positioners in accordance with an embodiment.

If desired, multiple feeders 84 may be used for any one or more of layers 82A, 82B, and 82C. This type of arrangement is shown in FIG. 12. As shown in FIG. 12, weft insertion equipment 26 may include multiple feeders such as feeder 84A controlled by positioner 86A and feeder 84B controlled by positioner 86B. Feeders 84A and 84B may operate independently of one another to create multiple regions 90 of weft segments 12S in fabric 20. Because regions 90 of weft segments 12S are created independently of one another, each region 90 may have a different pattern of weft segments. The widths of segments 12S within a given region 90 may be fixed or may be variable.

The example of FIG. 12 in which two feeders 84 are used to independently insert different weft strands 12-2 in fabric 20 is merely illustrative. If desired, one, two, three, four, or more than four feeders 84 may be used to insert and control the width of weft segments 12S in fabric 20. The ability to insert weft segments 12S with variable widths and patterns allows for the creation of regions 90 having different shapes, sizes, and functions in fabric 20. Regions 90 may create an aesthetically pleasing design in fabric 20 and/or may be used for functional purposes (e.g., to create different patterns, shapes, and sizes of touch-sensitive and/or force-sensitive regions in fabric 20).

FIGS. 13, 14, 15, and 16 show various patterns that can be made with a weft insertion strand using the equipment and methods described in FIGS. 4-12.

Figure 13:
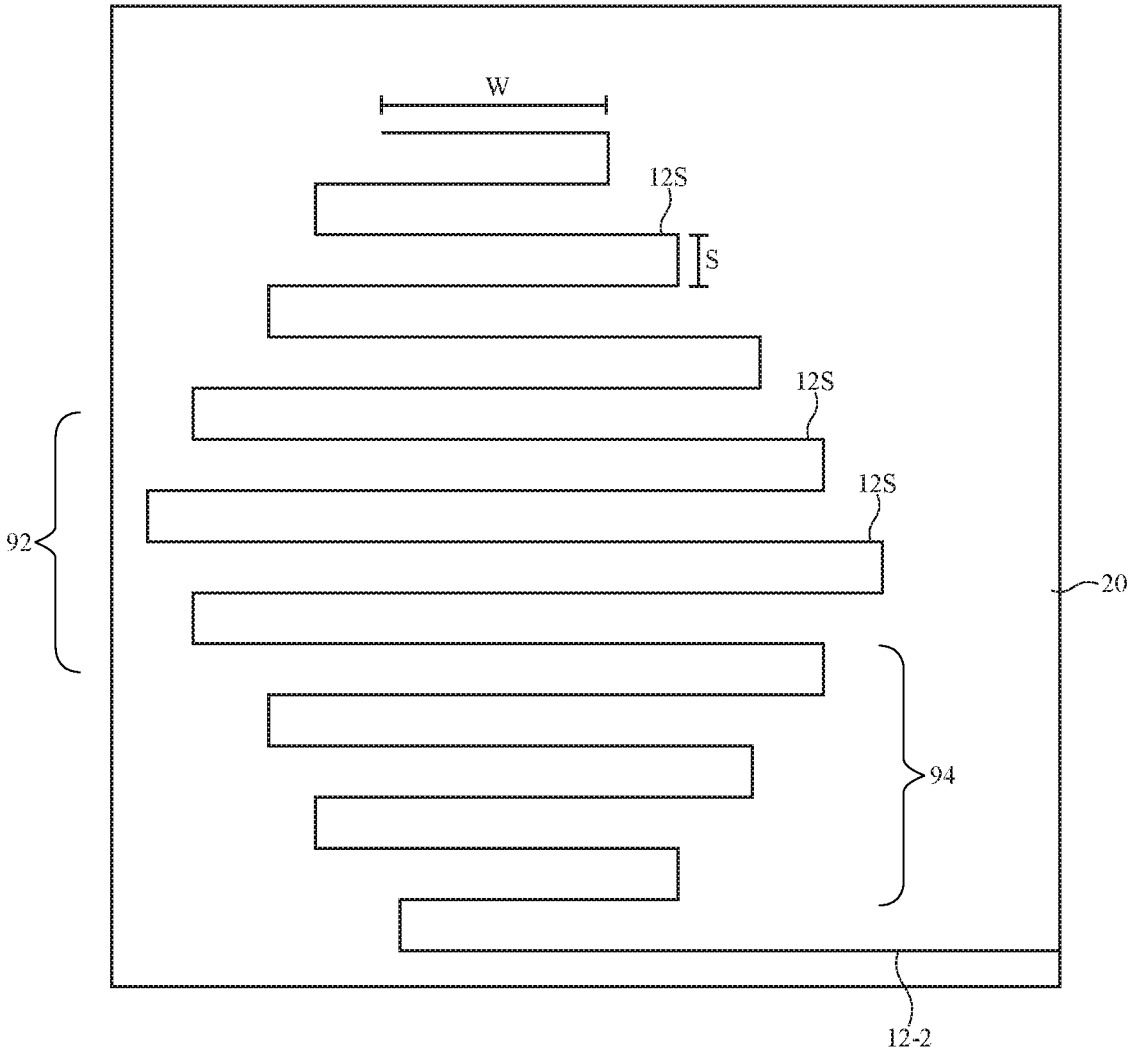
FIG. 13 is a top view of an illustrative warp knit fabric having a weft insertion strand with parallel segments of variable width in accordance with an embodiment.

In the example of FIG. 13, weft strand 12-2 forms a number of parallel weft segments 12S in fabric 20. Weft segments 12S may have different widths W. For example, weft segments 12S in region 92 may have a greater width than weft segments 12S in region 94. In this example, the spacing S between adjacent segments 12S is uniform in fabric 20. However, if desired, segments 12S may have a non-uniform spacing.

Figure 14:
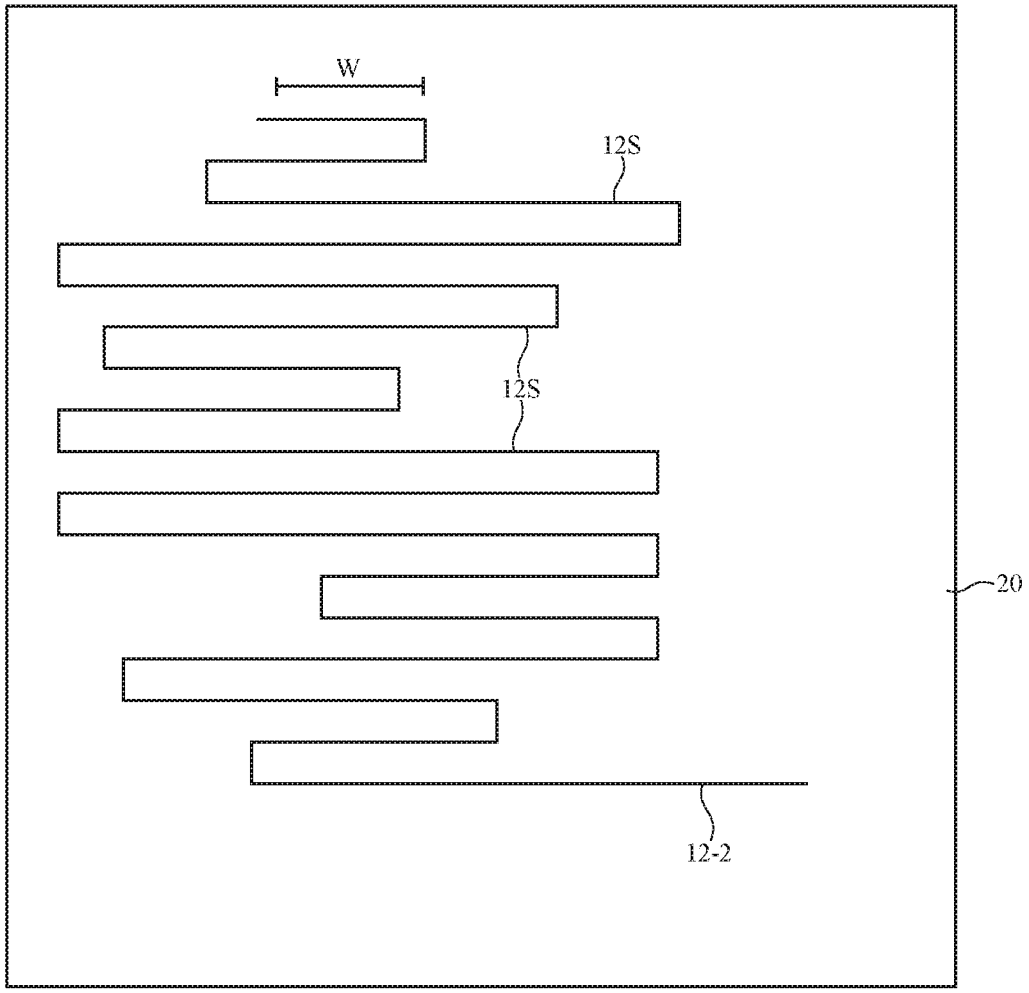
FIG. 14 is a top view of an illustrative warp knit fabric having a weft insertion strand with parallel segments of variable width and different patterns in accordance with an embodiment.
Figure 15:
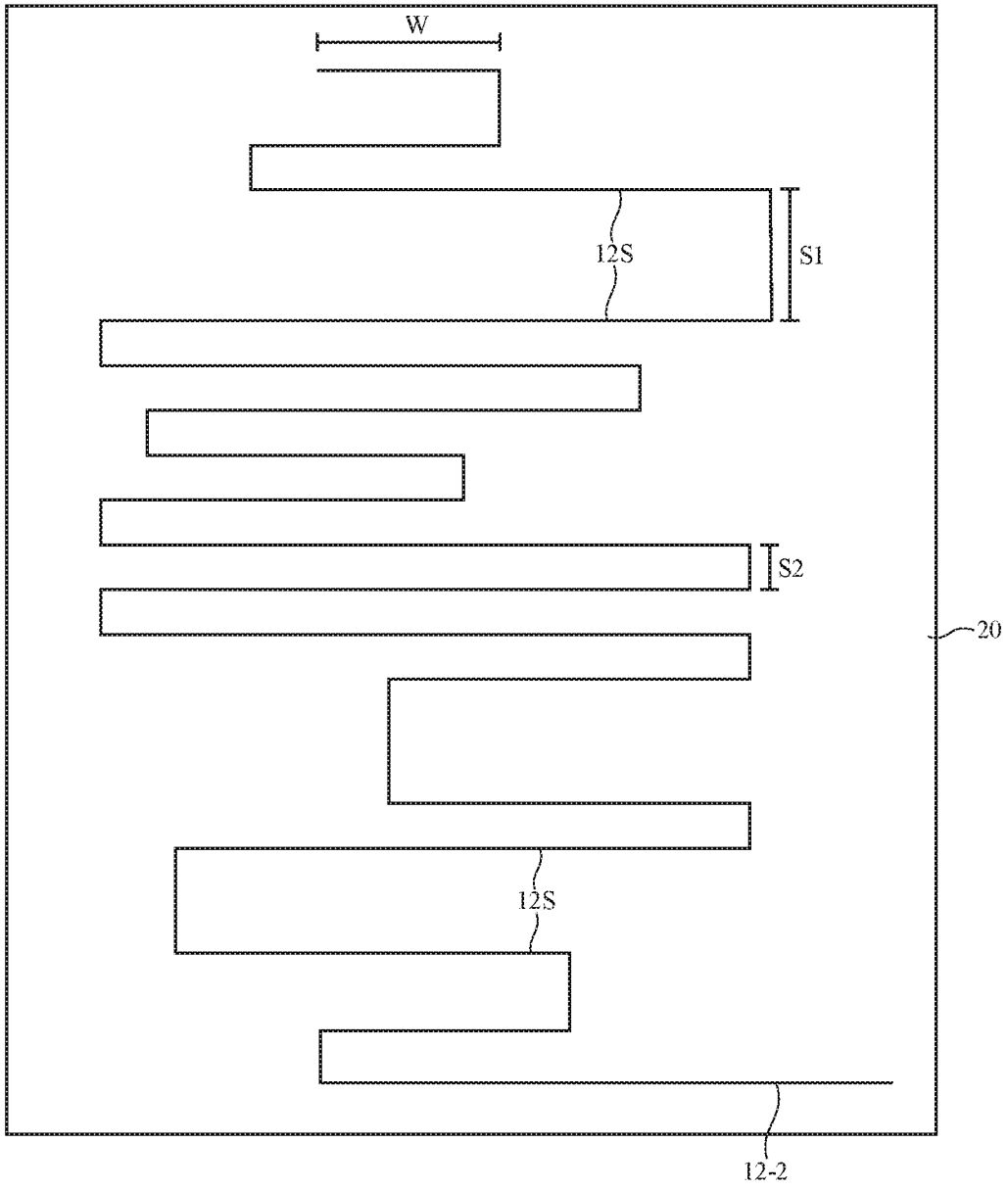
FIG. 15 is a top view of an illustrative warp knit fabric having a weft insertion strand with parallel segments of variable width and variable spacing in accordance with an embodiment.

In the example of FIG. 14, weft strand 12-2 has segments of variable width and has different patterns in different regions of fabric 20. In the example of FIG. 15, weft strand 12-2 has segments 12S with variable width and a variable spacing S between neighboring segments. For example, one pair of segments 12S may have be spaced apart by a distance 51, whereas another pair of segments 12S may be spaced apart by a distance S2 that is less than 51.

Figure 16:
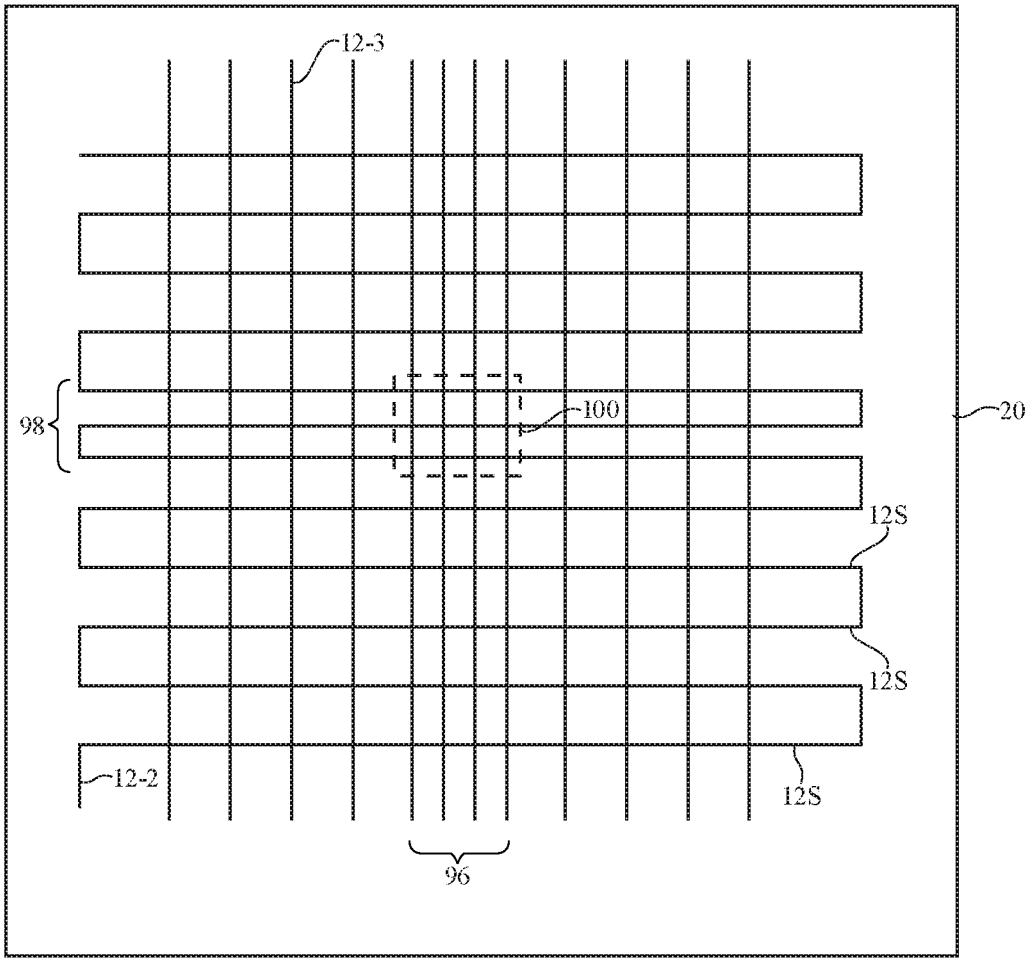
FIG. 16 is a top view of an illustrative warp knit fabric having weft insertion strands and warp insertion strands with variable spacing to produce regions with different resolutions in accordance with an embodiment.

In the example of FIG. 16, fabric 20 includes both weft insertion strands 12-2 and warp insertion strands 12-3. If desired, the spacing between weft strands 12-2 and the spacing between warp strands 12-3 may be adjusted to create regions of different resolutions. For example, as shown in FIG. 16, warp strands 12-3 in region 96 may be spaced closer together than warp strands 12-3 in other regions of fabric 20. Weft strands 12-2 in region 98 may be spaced closer together than weft strands 12-2 in other regions of fabric 20. This creates region 100 of closely spaced warp strands 12-3 and closely spaced weft strands 12-2. In arrangements where warp strands 12-3 and weft strands 12-2 are conductive, region 100 may create a discrete touch-sensitive and/or force-sensitive region in fabric 20.

In accordance with an embodiment, a warp knit fabric is provided that includes a plurality of warp strands intertwined with one another, the warp strands include a first warp strand that forms a first edge of the fabric and a second warp strand that forms a second edge of the fabric and a width of the warp knit fabric extends from the first edge to the second edge, and a weft strand inserted across the warp strands between the first and second edges of the fabric, the weft strand extends across less than all of the warp strands.

In accordance with another embodiment, the weft strand includes a conductive strand that conveys electrical signals.

In accordance with another embodiment, the weft strand has a plurality of parallel weft strand segments and each weft strand segment extends across at least some of the warp strands.

In accordance with another embodiment, the weft strand segments include at least first weft strand segment that extends across a first set of warp strands in the plurality of warp strands and a second weft strand segment that extends across a second set of warp strands in the plurality of warp strands that is different than the first set of warp strands.

In accordance with another embodiment, a spacing between the weft strand segments is uniform.

In accordance with another embodiment, a spacing between the weft strand segments of the weft strand is non-uniform.

In accordance with another embodiment, the warp knit fabric includes an additional weft strand inserted across the warp strands between the first and second edges of the fabric, the additional weft strand extends across less than all of the warp strands.

In accordance with another embodiment, the weft strand follows a first pattern in the warp knit fabric, the additional weft strand follows a second pattern in the warp knit fabric, and the first pattern is different than the second pattern.

In accordance with another embodiment, the weft strand extends across a first set of warp strands in the plurality of warp strands, the additional weft strand extends across a second set of warp strands in the plurality of warp strands, and the first set of warp strands is different than the second set of warp strands.

In accordance with an embodiment, a warp knit textile is provided that includes a first layer including a first plurality of warp strands and a first weft insertion strand that extends across less than all of the warp strands in the first plurality of warp strands, a second layer including a second plurality of warp strands, and a spacer layer interposed between the first and second layers and including a third plurality of warp strands that couple the first layer to the second layer.

In accordance with another embodiment, the second layer includes a second weft insertion strand that extends across less than all of the warp strands in the second plurality of warp strands.

In accordance with another embodiment, the first and second weft insertions strands include conductive strands.

In accordance with another embodiment, the third plurality of warp strands include insulating strands.

In accordance with another embodiment, the first weft insertion strand in the first layer overlaps the second weft insertion strand in the second layer.

In accordance with an embodiment, equipment for forming a warp knit textile is provided that includes a warp knitting machine that intertwines a plurality of warp strands, a weft insertion device that feeds weft insertion strands into the warp knitting machine across the warp strands, and a computer-controlled positioner that positions the weft insertion device relative to the warp knitting machine such that the weft insertion strands have different widths across the plurality of warp strands.

In accordance with another embodiment, the warp knitting machine includes a warp knitting machine selected from the group consisting of a tricot knitting machine, a single needle bar Raschel knitting machine, and a double needle bar Raschel knitting machine.

In accordance with another embodiment, the warp knitting machine has a width and the computer-controlled positioner moves the weft insertion device across less than all of the width of the warp knitting machine when the weft insertion device inserts a weft insertion strand.

In accordance with another embodiment, the warp knitting machine has a width, the computer-controlled positioner moves the weft insertion device across a first portion of the width of the warp knitting machine when the weft insertion device inserts a first weft insertion strand and across a second portion of the width of the warp knitting machine when the weft insertion device inserts a second weft insertion strand, and the first portion is different than the second portion.

In accordance with another embodiment, the equipment includes an additional weft insertion device that feeds additional weft insertion strands into the warp knitting machine across the warp strands, and an additional computer-controlled positioner that positions the additional weft insertion device relative to the warp knitting machine.

In accordance with another embodiment, the weft insertion device feeds the weft insertion strands into the warp knitting machine in a first pattern while the additional weft insertion device feeds the additional weft insertion strands into the warp knitting machine in a second pattern that is different than the first pattern.

The foregoing is merely illustrative and various modifications can be made by those skilled in the art without departing from the scope and spirit of the described embodiments. The foregoing embodiments may be implemented individually or in any combination.

What is claimed is:

1. A warp knit fabric, comprising:

a plurality of warp strands intertwined with one another, wherein the warp strands include a first warp strand that forms a first edge of the fabric and a second warp strand that forms a second edge of the fabric and wherein a width of the warp knit fabric extends from the first edge to the second edge; and a weft strand inserted across the warp strands between the first and second edges of the fabric, wherein the weft strand extends across less than all of the warp strands, wherein the weft strand is interposed between first and second consecutive rows of stitches in the warp knit fabric, and wherein the weft strand comprises a conductive strand that conveys electrical signals.

2. The warp knit fabric defined in claim 1 wherein the weft strand has a plurality of parallel weft strand segments and wherein each weft strand segment extends across at least some of the warp strands.

3. The warp knit fabric defined in claim 2 wherein the weft strand segments include at least first weft strand segment that extends across a first set of warp strands in the plurality of warp strands and a second weft strand segment that extends across a second set of warp strands in the plurality of warp strands that is different than the first set of warp strands.

4. The warp knit fabric defined in claim 2 wherein a spacing between the weft strand segments is uniform.

5. The warp knit fabric defined in claim 2 wherein a spacing between the weft strand segments of the weft strand is non-uniform.

6. The warp knit fabric defined in claim 1 further comprising:

an additional weft strand inserted across the warp strands between the first and second edges of the fabric, wherein the additional weft strand extends across less than all of the warp strands.

7. The warp knit fabric defined in claim 6 wherein the weft strand follows a first pattern in the warp knit fabric, wherein the additional weft strand follows a second pattern in the warp knit fabric, and wherein the first pattern is different than the second pattern.

8. The warp knit fabric defined in claim 6 wherein the weft strand extends across a first set of warp strands in the plurality of warp strands, wherein the additional weft strand extends across a second set of warp strands in the plurality of warp strands, and wherein the first set of warp strands is different than the second set of warp strands.

9. A warp knit textile, comprising:

a first layer comprising a first plurality of warp strands and a weft insertion strand that extends across less than all of the warp strands in the first plurality of warp strands, wherein the weft insertion strand is interposed between first and second consecutive rows of stitches in the first layer;

a second layer comprising a second plurality of warp strands; and a spacer layer interposed between the first and second layers and comprising a third plurality of warp strands that couple the first layer to the second layer.

10. The warp knit textile defined in claim 9 wherein the second layer comprises an additional weft insertion strand that extends across less than all of the warp strands in the second plurality of warp strands.

11. The warp knit textile defined in claim 10 wherein the weft insertion strand and the additional weft insertion strand comprise conductive strands.

12. The warp knit textile defined in claim 11 wherein the third plurality of warp strands comprise insulating strands.

13. The warp knit textile defined in claim 12 wherein the insertion strand in the first layer overlaps the additional weft insertion strand in the second layer.

* * * * *